US009773486B2

(12) United States Patent
Lopiccolo et al.

(10) Patent No.: US 9,773,486 B2
(45) Date of Patent: Sep. 26, 2017

(54) VOCAL IMPROVISATION

(71) Applicant: Harmonix Music Systems, Inc., Boston, MA (US)

(72) Inventors: Gregory B. Lopiccolo, Brookline, MA (US); David Plante, Roslindale, MA (US); Sharat Bhat, Somerville, MA (US)

(73) Assignee: Harmonix Music Systems, Inc., Boston, MA (US)

( * ) Notice: Subject to any disclaimer, the term of this patent is extended or adjusted under 35 U.S.C. 154(b) by 0 days.

(21) Appl. No.: 15/278,596

(22) Filed: Sep. 28, 2016

(65) Prior Publication Data

US 2017/0092252 A1 Mar. 30, 2017

Related U.S. Application Data

(60) Provisional application No. 62/233,721, filed on Sep. 28, 2015.

(51) Int. Cl.

| | |
|---|---|
| ***G10H 1/36*** | (2006.01) |
| ***G10H 7/00*** | (2006.01) |
| ***G10H 1/00*** | (2006.01) |

(52) U.S. Cl.

CPC ..... *G10H 1/361* (2013.01); *G10H 1/0008* (2013.01); *G10H 1/368* (2013.01); (Continued)

(58) Field of Classification Search

CPC ..... G10H 1/361; G10H 1/0008; G10H 1/368; G10H 2210/066; G10H 2210/071; (Continued)

(56) References Cited

U.S. PATENT DOCUMENTS

| | | | |
|---|---|---|---|
| 3,897,711 | A | 8/1975 | Elledge |
| 4,128,037 | A | 12/1978 | Montemurro |

(Continued)

FOREIGN PATENT DOCUMENTS

| | | | |
|---|---|---|---|
| DE | 19833989 | A1 | 2/2000 |
| EP | 1 029 566 | A2 | 8/2000 |

(Continued)

OTHER PUBLICATIONS

"HF Transceiver and Receiver VFO Calibration: Methods #1 and #2", http://web.archive.org/web/20071119171602/http://www.hflink.com/calibration/, accessed May 21, 2012 (2 pages).

(Continued)

*Primary Examiner* — Jeffrey Donels

(74) *Attorney, Agent, or Firm* — Wilmer Cutler Pickering Hale and Dorr LLP

(57) ABSTRACT

The present disclosure is directed at methods and systems for implementing and scoring a vocal improvisation feature in a music video game. This feature can allow players of music video games to sing improvised harmonies for a song using a microphone controller. The improvised harmonies can be musically consonant with a pre-authored melody track programmed into the music video game. The improvised harmonies can comprise pre-authored notes programmed into the pre-authored melody track, or can be generated by the music video game during run-time based on the pre-authored melody track. The music video game can also display guidelines visually showing permissible harmony tracks in relation to the pre-authored melody track.

21 Claims, 8 Drawing Sheets

(52) U.S. Cl.
CPC . *G10H 2210/066* (2013.01); *G10H 2210/071* (2013.01); *G10H 2210/091* (2013.01); *G10H 2220/015* (2013.01); *G10H 2220/135* (2013.01); *G10H 2240/145* (2013.01)

(58) Field of Classification Search
CPC ..... G10H 2210/091; G10H 2210/015; G10H 2220/135; G10H 2240/145
USPC ..... 84/610
See application file for complete search history.

(56) References Cited

U.S. PATENT DOCUMENTS 4,295,406 A 10/1981 Smith
4,794,838 A 1/1989 Corrigau, III
5,109,482 A 4/1992 Bohrman
5,140,889 A 8/1992 Segan et al.
5,393,926 A 2/1995 Johnson
5,469,370 A 11/1995 Ostrover et al.
5,510,573 A 4/1996 Cho et al.
5,513,129 A 4/1996 Bolas et al.
5,557,057 A 9/1996 Starr
5,739,457 A 4/1998 Devecka
5,777,251 A 7/1998 Hotta et al.
6,075,197 A 6/2000 Chan
6,111,179 A 8/2000 Miller
6,162,981 A 12/2000 Newcomer et al.
6,225,547 B1 5/2001 Toyama et al.
6,252,153 B1 6/2001 Toyama
6,268,557 B1 7/2001 Devecka
6,342,665 B1 1/2002 Okita et al.
6,347,998 B1 2/2002 Yoshitomi et al.
6,369,313 B2 4/2002 Devecka
6,379,244 B1 4/2002 Sagawa et al.
6,390,923 B1 5/2002 Yoshitomi et al.
6,410,835 B2 6/2002 Suzuki et al.
6,425,822 B1 7/2002 Hayashida et al.
6,438,611 B1 8/2002 Hara et al.
6,461,239 B1 10/2002 Sagawa et al.
6,482,087 B1 11/2002 Egozy et al.
6,483,018 B2 11/2002 Mead
6,541,692 B2 4/2003 Miller
6,555,737 B2 4/2003 Miyaki et al.
6,645,067 B1 11/2003 Okita et al.
6,653,545 B2 11/2003 Redmann et al.
6,663,491 B2 12/2003 Watabe et al.
6,685,480 B2 2/2004 Nishimoto et al.
6,699,123 B2 3/2004 Matsuura et al.
6,835,887 B2 12/2004 Devecka
6,850,252 B1 2/2005 Hoffberg
6,905,413 B1 6/2005 Terao et al.
6,924,425 B2 8/2005 Naples et al.
6,936,758 B2 8/2005 Itoh
6,987,221 B2 1/2006 Platt
7,078,607 B2 7/2006 Alferness
7,083,519 B2 8/2006 Toyoshima
7,164,076 B2 1/2007 McHale et al.
7,208,672 B2 4/2007 Camiel
7,220,910 B2 5/2007 Plastina et al.
7,223,913 B2 5/2007 Knapp et al.
7,232,949 B2 6/2007 Hruska et al.
7,320,643 B1 1/2008 Brosius et al.
D569,382 S 5/2008 Yow et al.
7,459,324 B1 12/2008 Ptasinski et al.
7,459,624 B2 12/2008 Schmidt et al.
7,525,036 B2 4/2009 Shotwell et al.
7,559,834 B1 7/2009 York
7,789,741 B1 9/2010 Fields et al.
7,840,288 B2 11/2010 Graepel et al.
7,855,333 B2 12/2010 Miyajima et al.
7,855,334 B2 12/2010 Yamashita et al.
7,935,880 B2 5/2011 Stoddard et al.
7,982,114 B2 7/2011 Applewhite et al.
8,003,872 B2 * 8/2011 Lopiccolo ..... G10H 1/342 463/43
8,017,857 B2 9/2011 Chiu et al.
8,026,435 B2 9/2011 Stoddard et al.
8,076,574 B2 12/2011 Irmer et al.
8,173,883 B2 5/2012 Willacy et al.
8,198,526 B2 6/2012 Izen et al.
8,324,494 B1 12/2012 Packouz
8,449,360 B2 5/2013 Stoddard et al.
8,663,013 B2 3/2014 Egozy et al.
8,690,670 B2 * 4/2014 Kay ..... A63F 13/10 463/31
9,033,795 B2 5/2015 Yum
9,324,216 B2 4/2016 Janosov
2002/0002900 A1 1/2002 Cho
2002/0025842 A1 2/2002 Nobe et al.
2002/0032054 A1 3/2002 Hosoya
2002/0088337 A1 7/2002 Devecka
2002/0128736 A1 9/2002 Yoshida et al.
2002/0142818 A1 10/2002 Nakatsuka et al.
2002/0160824 A1 10/2002 Goto et al.
2002/0169014 A1 11/2002 Egozy et al.
2003/0014262 A1 1/2003 Kim
2003/0083130 A1 5/2003 Toyoshima
2003/0164084 A1 9/2003 Redmann et al.
2004/0132518 A1 7/2004 Uehara et al.
2004/0148159 A1 7/2004 Crockett et al.
2004/0229685 A1 11/2004 Smith et al.
2004/0244566 A1 12/2004 Steiger
2005/0070359 A1 3/2005 Rodriquez et al.
2005/0101364 A1 5/2005 Onoda et al.
2005/0120865 A1 6/2005 Tada
2005/0235809 A1 10/2005 Kageyama
2005/0255914 A1 11/2005 McHale et al.
2005/0273319 A1 12/2005 Dittmar et al.
2006/0058101 A1 3/2006 Rigopulos
2006/0127053 A1 6/2006 Lee
2006/0191401 A1 8/2006 Ueshima et al.
2006/0205506 A1 9/2006 Toyoshima
2006/0258450 A1 11/2006 Ishihata et al.
2006/0266200 A1 11/2006 Goodwin
2006/0287106 A1 12/2006 Jensen
2006/0290810 A1 12/2006 Mallinson
2007/0015571 A1 1/2007 Walker et al.
2007/0059670 A1 3/2007 Yates
2007/0081562 A1 4/2007 Ma
2007/0087835 A1 4/2007 Van Luchene
2007/0111802 A1 5/2007 Ishihara et al.
2007/0140510 A1 6/2007 Redmann
2007/0163427 A1 7/2007 Rigopulos et al.
2007/0163428 A1 7/2007 Salter
2007/0232374 A1 10/2007 Lopiccolo et al.
2007/0234881 A1 10/2007 Takehisa
2007/0234885 A1 10/2007 Schmidt et al.
2007/0243915 A1 10/2007 Egozy et al.
2007/0245881 A1 10/2007 Egozy et al.
2008/0009346 A1 1/2008 Jessop et al.
2008/0076497 A1 3/2008 Kiskis et al.
2008/0102958 A1 5/2008 Kitamura et al.
2008/0113698 A1 5/2008 Egozy
2008/0200224 A1 8/2008 Parks
2008/0220864 A1 9/2008 Brosius et al.
2008/0255914 A1 10/2008 Oren et al.
2008/0268943 A1 10/2008 Jacob
2008/0280680 A1 11/2008 Dutilly et al.
2008/0311969 A1 12/2008 Kay et al.
2008/0311970 A1 12/2008 Kay et al.
2009/0075711 A1 3/2009 Brosius et al.
2009/0088249 A1 4/2009 Kay et al.
2009/0104956 A1 4/2009 Kay et al.
2009/0107320 A1 4/2009 Willacy et al.
2009/0258686 A1 10/2009 McCauley et al.
2010/0009749 A1 1/2010 Chrzanowski, Jr. et al.
2010/0016079 A1 1/2010 Jessop
2010/0041477 A1 2/2010 Kay et al.
2010/0137049 A1 6/2010 Epstein
2010/0300264 A1 12/2010 Foster
2010/0300265 A1 12/2010 Foster et al.
2010/0300266 A1 12/2010 Stoddard et al.
2010/0300268 A1 12/2010 Applewhite et al.
2010/0300269 A1 12/2010 Applewhite

(56) References Cited

U.S. PATENT DOCUMENTS

| | | | | |
|---|---|---|---|---|
| 2010/0300270 | A1* | 12/2010 | Applewhite | G10H 1/0058 84/610 |
| 2010/0304810 | A1* | 12/2010 | Stoddard | G10H 1/368 463/7 |
| 2010/0304811 | A1 | 12/2010 | Schmidt et al. | |
| 2010/0304863 | A1 | 12/2010 | Applewhite et al. | |
| 2010/0307321 | A1 | 12/2010 | Mann et al. | |
| 2010/0319517 | A1 | 12/2010 | Savo et al. | |
| 2011/0028214 | A1 | 2/2011 | Bright et al. | |
| 2011/0086705 | A1 | 4/2011 | Chiu et al. | |
| 2011/0251840 | A1 | 10/2011 | Cook et al. | |
| 2011/0306397 | A1 | 12/2011 | Fleming et al. | |
| 2014/0020546 | A1 | 1/2014 | Sumi | |
| 2014/0318347 | A1 | 10/2014 | Wang et al. | |
| 2015/0161978 | A1 | 6/2015 | Packouz | |
| 2016/0240179 | A1 | 8/2016 | Uemura et al. | |
| 2016/0343362 | A1 | 11/2016 | Brosius et al. | |
| 2017/0025107 | A1 | 1/2017 | Packouz | |
| 2017/0025108 | A1 | 1/2017 | Packouz | |
| 2017/0092252 | A1 | 3/2017 | Lopiccolo et al. | |
| 2017/0092254 | A1 | 3/2017 | Lopiccolo et al. | |

FOREIGN PATENT DOCUMENTS

| | | | |
|---|---|---|---|
| EP | 1081680 | A1 | 3/2001 |
| EP | 1 096 468 | A2 | 5/2001 |
| EP | 1145749 | A2 | 10/2001 |
| EP | 1 825 896 | A1 | 8/2007 |
| JP | 2000288254 | | 10/2000 |
| JP | 2001075579 | | 3/2001 |
| WO | WO-8601927 | A1 | 3/1986 |
| WO | WO-2004008430 | A1 | 1/2004 |
| WO | WO-2007055522 | A1 | 5/2007 |
| WO | WO-2007115072 | A1 | 10/2007 |
| WO | WO-2007115299 | A2 | 10/2007 |

OTHER PUBLICATIONS

Association of British Scrabble Players, "Rolling System", ABSP, URL<http://www.absp.org.uk/results/ratings_detail.shtml>, accessed May 25, 2011 (4 pages).

Audio Grafitti: "Audio Graffiti: Guide to Drum & Percussion Notation", URL:http://web/mit.edu/merolish/Public/drums.pdf, Aug. 2004 (4 pages).

Dance Dance Revolution Max, Game Manual, Konami Corporation, released in the US on Oct. 29, 2009 (2 pages).

Definition of "Magnitude", Google.com, https://www.google.com/search?q=define%3Amagnitude&sugexp=chome,mod=1&sourceid=chrome . . . , retrieved Aug. 16, 2012 (2 pages).

European Extended Search Report issued in EP16170347.5, dated Sep. 23, 2016 (8 pages).

GamesRadar Guitar Hero Summary, http://www.web.archive.org/web/20080212013350/http://www.gamesradar.com/ps2/ . . . /g-2005121692014883026, accessed Jul. 8, 2012 (3 pages).

Guitar Hero (video game)—Wikipedia, the free encyclopedia, Release Date Nov. 2005, http://en.wikipedia.org/w/index.php?title=guitary_hero&oldid=137778068, accessed May 22, 2012 (5 pages).

Guitar Hero—Wikipedia, the free encyclopedia—Released Nov. 8, 2005, http://en.wikipedia.org/wiki/Guitar_Hero_(series), accessed Mar. 20, 2009 (25 pages).

Guitar Hero Reviewed by T. Prime, http://www.gamefaqs.com/console/ps2/review/R113400.html, accessed Jan. 2, 2010 (2 pages).

Guitar Hero Review by Misfit119, Retrieved Jan. 2, 2010. http://www.gamefaqs.com/console/ps2/review/R110926.html (1 page).

Guitar Hero Review by Ninjujitsu. Retrieved Jan. 2, 2010. http://www.gamefaqs.com/console/ps2/review/R94093.html (1 page).

Guitar Hero Review by SaxMyster. Retrieved Jan. 2, 2010, http://www.gamefaqs.com/console/ps2/review/R109815.html (1 page).

GuitarFreaks—Wikipedia, the free encyclopedia—(Publisher—Konami, Konami Digital Entertainment) Release Date 1998, http://en/wikipedia.org/wiki/GuitarFreaks,http://en.wikipedia.org/wiki/List_of_GuitarFreaks_and_Drummania_Games, accessed Mar. 19, 2009 (5 pages).

Index of /Partitions, entersandman.com, http://web.archive.org/web/20061021231758/http://batterieandcosite.free.fr/Partitions, pp. 1, 22, and 36, accessed Oct. 2, 2008 (3 pages).

Lohman, T., "Rockstar vs Guitar Hero", UNLV: The Rebel Yell—Nov. 13, 2008, http://unlvrebelyell.com/2008/11/13/rockstar-vs-guitar-hero/, accessed Mar. 19, 2009 (5 pages).

Nakano, T., et al., "Voice Drummer: A Music Notation Interface of Drum Sounds Using Voice Percussion Input", UIST '05—Adjunct Proceedings of the 18th Annual ACM Symposium on User Interface Software and Technology, Oct. 23-27, 2005, Seattle, WA, USA (2 pages).

NCSX.com: Game Synopsys of Guitar Freaks & DrumMania Masterpiece Gold, with a date of Mar. 8, 2007, and with an Archive.org Wayback Machine verified date of May 17, 2007, downloaded from http://web.archive.org/web/20070517210234/http://www.ncsx.com/2007/030507/guitarfreaks_gold.htm, National Console Support, Inc., accessed Jun. 7, 2011 (4 pages).

Ramsey, Aaron, "GuitarFreaks & DrumMania Masterpiece Gold FAQ v1.04", with a revision date of Apr. 2, 2007, and with an Archive.org Wayback Machine verified date of Apr. 22, 2007, downloaded from http://web/archive.org/web/20070422184212/http://www.gamefaqs.com/console/ps2/file/9 . . . , accessed Jun. 10, 2011 (52 pages).

RedOctane. "Guitar Hero II Manual", game manual, Activision Publishing, Inc., 2006 (13 pages).

Rock Band (video game), Wikipedia, the free encyclopedia, http://en.wikipedia.org/wiki/Rock_Band_(video_game), accessed Jul. 26, 2011 (29 pages).

Rock Band Wii Instructional Booklet, Harmonix Music Systems, Inc., 2008 (15 pages).

Sheet Music: "Enter Sandman", by Metallica, URL:http://batterieandcosite.free.fr/Partitions/entersandman.pdf (4 pages).

Taiko Drum Master Instruction Manual, NAMCO, 2004 (18 pages).

Virginia Tech Multimedia Music Dictionary: "P: Phrase", Virginia Tech University URL:<http://www.music.vt.edu/musicdictionary/textp/Phrase.html>, accessed May 25, 2011 (7 pages).

* cited by examiner

VOCAL IMPROVISATION

RELATED APPLICATIONS

This application claims benefit under 35 U.S.C. §119(e) of U.S. Provisional Patent Application No. 62/233,721, filed Sep. 28, 2015, entitled "Vocal Improvisation," the content of which is incorporated by reference in its entirety.

FIELD OF THE INVENTION

The present invention relates to video games, and, more specifically, rhythm-action games which simulate the experience of playing musical instruments.

BACKGROUND OF THE INVENTION

Music making is often a collaborative effort among many musicians who interact with each other. One form of musical interaction may be provided by a video game genre known as "rhythm-action," which involves a player performing phrases from an assigned, prerecorded musical composition using a video game's input device to simulate a musical performance. If the player performs a sufficient percentage of the notes or cues displayed for the assigned part, the player may score well for that part and win the game. If the player fails to perform a sufficient percentage, the player may score poorly and lose the game. Two or more players may compete against each other, such as by each one attempting to play back different, parallel musical phrases from the same song simultaneously, by playing alternating musical phrases from a song, or by playing similar phrases simultaneously. The player who plays the highest percentage of notes correctly may achieve the highest score and win.

Two or more players may also play with each other cooperatively. In this mode, players may work together to play a song, such as by playing different parts of a song, either on similar or dissimilar instruments. One example of a rhythm-action game with different instruments is the ROCK BAND® series of games, developed by Harmonix Music Systems, Inc. ROCK BAND® simulates a band experience by allowing players to play a rhythm-action game using various simulated instruments, e.g., a simulated guitar, a simulated bass guitar, a simulated drum set, or by singing into a microphone.

Past rhythm-action games that have been released for home consoles have utilized a variety of controller types. For example, GUITAR HERO II, published by Red Octane, could be played with a simulated guitar controller or with a standard game console controller.

SUMMARY

The present disclosure is directed at methods and systems for implementing and scoring a vocal improvisation feature in a music video game. This feature can allow players of music video games to sing improvised harmonies for a song using a microphone controller. The improvised harmonies can correspond to a pre-authored melody track programmed into the music video game. The improvised harmonies can comprise pre-authored notes programmed into the pre-authored melody track, or can be generated by the music video game during run-time based on the pre-authored melody track. The music video game can also display guidelines visually showing permissible harmony tracks in relation to the pre-authored melody track.

In one aspect, the present disclosure is directed at a computer system for evaluating a player's vocal performance when the vocal performance comprises at least some vocal improvisation that does not correspond to a melody of a musical track. The system can comprise a game console having a memory that stores the musical track, the musical track having a first set of notes corresponding to the melody. The system can also comprise at least one processor configured to determine, based on the first set of notes, a second set of notes corresponding to potential harmonies that, when sung in combination with the first set of notes (i.e., when sung in combination with the melody), can create a pleasing and musically consonant sound. The at least one processor can also be configured to receive vocal input corresponding to the player's vocal performance, to determine if a pitch of the vocal input falls within a pre-determined range of at least one note of the first set of notes or at least one note of the second set of notes, and to increase a score of the player when the pitch of the vocal input falls within the pre-determined range of at least one note of the first set of notes or at least one note of the second set of notes.

In some embodiments, the at least one processor can be configured to decrease or leave unchanged the score of the player when the pitch of the vocal input does not fall within the pre-determined range of at least one note of the first set of notes or at least one note of the second set of notes.

In some embodiments, the system can include a video rendering module coupled to the at least one processor, wherein the at least one processor is further configured to transmit to the video rendering module display data comprising a lane having a first set of cues corresponding to the first set of notes, and a second set of cues corresponding to the second set of notes.

In some embodiments, the at least one processor can be further configured to change, via the video rendering module, the appearance of a selected cue in the second set of cues when the pitch of the vocal input falls within the pre-determined range of a note that corresponds to the selected cue.

In some embodiments, the score of the player can a score for a musical phrase, the score being subdivided into a first part and a second part, and the at least one processor can be configured to increase the first part of the score when the pitch of the vocal input falls within the pre-determined range of at least one note of the first set of notes, and to increase the second part of the score when the pitch of the vocal input falls within the pre-determined range of at least one note of the second set of notes.

In some embodiments, the at least one processor can also be configured to determine if a rhythm of the vocal input corresponds to a rhythm associated with the musical track, and if so, to increase the score of the player.

In some embodiments, the at least one processor can be configured to determine the second set of notes during run-time.

In some embodiments, the musical track does not contain any authored information corresponding to the second set of notes.

In some embodiments, the at least one processor can be configured to determine the second set of notes based on root notes of musical chords associated with the first set of notes.

In some embodiments, the at least one processor can be configured to determine the second set of notes based on metadata associated with the musical track.

In some embodiments, the system can further comprise a sound synthesize coupled to the at least one processor, wherein the at least one processor is further configured to transmit to the sound synthesizer an audible soundtrack corresponding to the musical track while receiving the vocal input.

In some embodiments, the second set of notes does not correspond to an audible harmony in the audible soundtrack.

In another aspect, the present disclosure is directed at a method for evaluating a player's vocal performance comprising at least some vocal improvisation that does not correspond to a melody of a musical track. The method can comprise loading data corresponding to the musical track into memory, the data including a first set of notes corresponding to the melody. The method can also comprise accessing the data corresponding to the musical track from at least one memory. The method can also comprise determining, based on the first set of notes, a second set of notes corresponding to potential harmonies that, when sung in combination with the first set of notes, can create a pleasing and musically consonant sound. The method can also comprise receiving vocal input corresponding to the player's vocal performance, and determining if a pitch of the vocal input falls within a pre-determined range of at least one note of the first set of notes or at least one note of the second set of notes. The method can also comprise increasing a score of the player when the pitch of the vocal input falls within the pre-determined range of at least one note of the first set of notes or at least one note of the second set of notes.

In some embodiments, the method can comprise decreasing or leaving unchanged the score of the player when the pitch of the vocal input does not fall within the pre-determined range of at least one note of the first set of notes or at least one note of the second set of notes.

In some embodiments, the method can comprise displaying, via a video rendering module, a lane having a first set of cues corresponding to the first set of notes, and a second set of cues corresponding to the second set of notes.

In some embodiments, the method can comprise changing the appearance of a selected cue in the second set of cues when the pitch of the vocal input falls within the pre-determined range of a note that corresponds to the selected cue.

In some embodiments, the score of the player can be subdivided into a first part and a second part, and the method can further comprise increasing the first part of the score when the pitch of the vocal input falls within the pre-determined range of at least one note in the first set of notes, and increasing the second part of the score when the pitch of the vocal input falls within the pre-determined range of at least one note of the second set of notes.

In some embodiments, the method can also comprise determining if a rhythm of the vocal input corresponds to a rhythm associated with the musical track, and if so, increasing the score of the player.

In some embodiments, the determination of the second set of notes can occur during run-time.

In some embodiments, the data corresponding to the musical track does not contain any authored information corresponding to the second set of notes.

In some embodiments, the determination of the second set of notes is based on root notes of musical chords associated with the first set of notes.

In some embodiments, the determination of the second set of notes is based on metadata associated with the musical track.

In some embodiments, the method can also comprise transmitting an audible soundtrack corresponding to the musical track while receiving the vocal input.

In some embodiments, the second set of notes does not correspond to an audible harmony in the audible soundtrack.

In another aspect, the present disclosure is directed at non-transitory computer readable media storing machine-readable instructions that are configured to, when executed by at least one processor, cause the at least one processor to access the musical track from at least one memory in communication with the at least one processor, the musical track having a first set of notes corresponding to the melody. The instructions can further cause the at least one processor to determine a second set of notes corresponding to potential harmonies that are musically consonant with the melody, receive vocal input corresponding to the player's vocal performance, and determine if a pitch of the vocal input falls within a pre-determined range of at least one note of the first set of notes or at least one note of the second set of notes. The instructions can further cause the at least one processor to increase a score of the player when the pitch of the vocal input falls within the pre-determined range of at least one note of the first set of notes or at least one note of the second set of notes.

BRIEF DESCRIPTION OF THE DRAWINGS

The foregoing and other objects, features, and advantages of the inventions herein, as well as the inventions themselves, will be more fully understood from the following description of various embodiments, when read together with the accompanying drawings, in which.

DETAILED DESCRIPTION

Embodiments of the disclosed subject matter can provide techniques for implementing a vocal improvisation feature that allows players of rhythm-action video games to sing improvised harmonies for a song using a microphone controller. In some embodiments, the improvised harmonies can correspond with a pre-authored melody track programmed into the rhythm-action video game. One of the objects of this improvised vocal improvisation feature is to create a new and exciting feature for vocal gameplay, and to make vocal gameplay feel less rote and restrictive. The vocal improvisation feature can also give expert vocalists opportunities to sing more expressively, and provide more variety to songs upon repeated playthroughs.

Figure 1A:
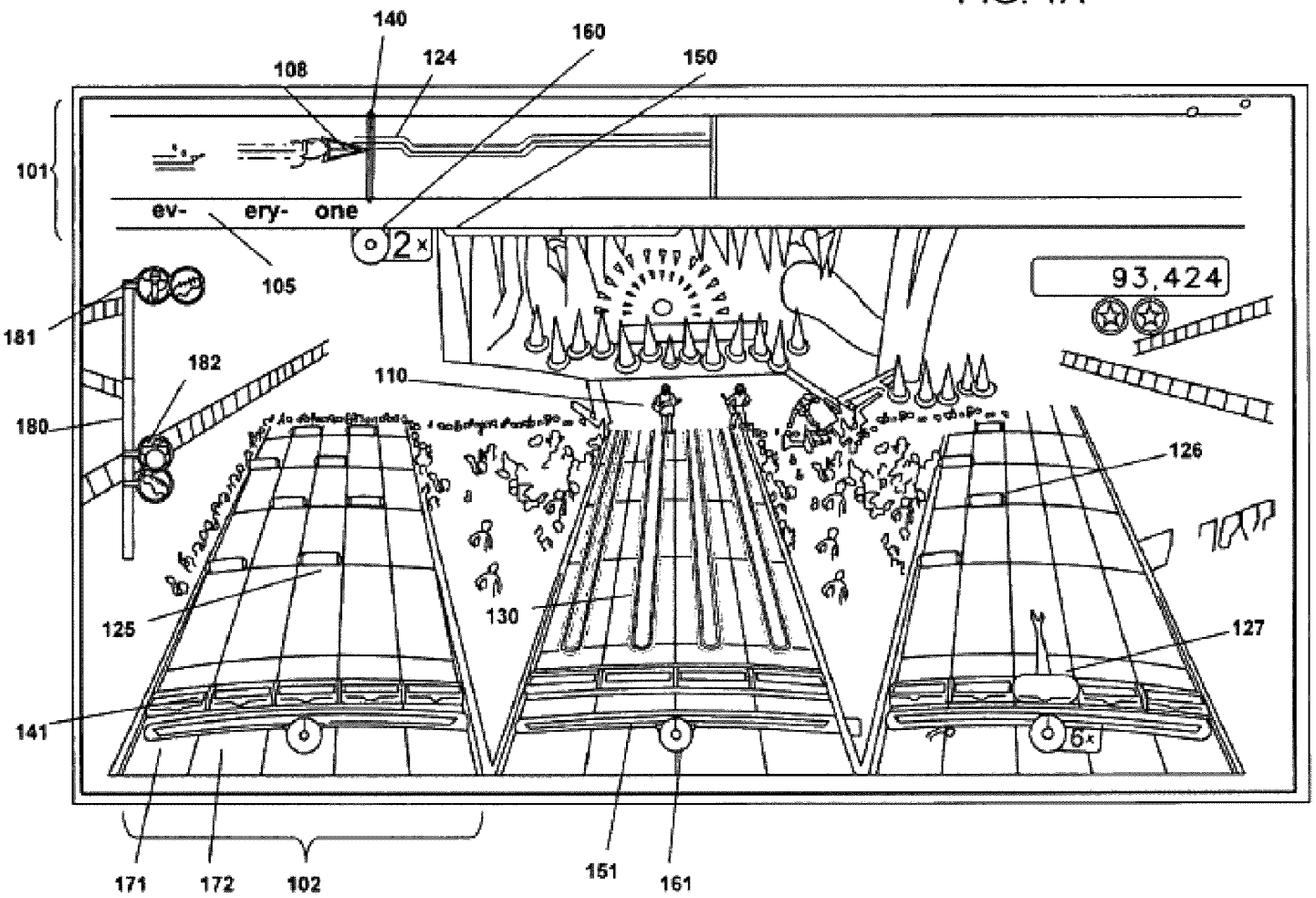
FIG. 1A shows an embodiment of a screen display for a video game in which four players emulate a musical performance, according to some embodiments.

Referring now to FIG. 1A, an embodiment of a screen display for a video game in which four players emulate a musical performance is shown. One or more of the players may be represented on screen by an avatar 110. Although FIG. 1A depicts an embodiment in which four players participate, any number of players may participate simultaneously. For example, a fifth player may join the game as a keyboard player. In this case, the screen may be further subdivided to make room to display a fifth avatar and/or music interface. In some embodiments, an avatar 110 may be a computer-generated image. In other embodiments, an avatar may be a digital image, such as a video capture of a person. An avatar may be modeled on a famous figure or, in some embodiments, the avatar may be modeled on the game player associated with the avatar.

Still referring to FIG. 1A, a lane 101 or 102 has one or more game "cues" 124, 125, 126, 127, 130 corresponding to musical events distributed along the lane. During gameplay, the cues, also referred to as "musical targets," "gems," or "game elements," appear to flow toward a target marker 140, 141. In some embodiments, the cues may appear to be flowing towards a player. The cues are distributed on the lane in a manner having some relationship to musical content associated with the game level, such as a song playing in the background of the game. For example, the cues may represent note information (gems spaced more closely together for shorter notes and further apart for longer notes), pitch (gems placed on the left side of the lane for notes having lower pitch and the right side of the lane for higher pitch), volume (gems may glow more brightly for louder tones), duration (gems may be "stretched" to represent that a note or tone is sustained, such as the gem 127), articulation, timbre or any other time-varying aspects of the musical content. The cues may be any geometric shape and may have other visual characteristics, such as transparency, color, or variable brightness.

As the gems move along a respective lane, musical data represented by the gems may be substantially simultaneously played as audible music. In some embodiments, audible music represented by a gem is only played (or only played at full or original fidelity) if a player successfully "performs the musical content" by capturing or properly executing the gem. In some embodiments, a musical tone is played to indicate successful execution of a musical event by a player. In other embodiments, a stream of audio is played to indicate successful execution of a musical event by a player. In certain embodiments, successfully performing the musical content triggers or controls the animations of avatars.

In other embodiments, the audible music, tone, or stream of audio represented by a cue is modified, distorted, or otherwise manipulated in response to the player's proficiency in executing cues associated with a lane. For example, various digital filters can operate on the audible music, tone, or stream of audio prior to being played by the game player. Various parameters of the filters can be dynamically and automatically modified in response to the player capturing cues associated with a lane, allowing the audible music to be degraded if the player performs poorly or enhancing the audible music, tone, or stream of audio if the player performs well. For example, if a player fails to execute a game event, the audible music, tone, or stream of audio represented by the failed event may be muted, played at less than full volume, or filtered to alter its sound.

In certain embodiments, a "wrong note" sound may be substituted for the music represented by the failed event. Conversely, if a player successfully executes a game event, the audible music, tone, or stream of audio may be played normally. In some embodiments, if the player successfully executes several, successive game events, the audible music, tone, or stream of audio associated with those events may be enhanced, for example, by adding an echo or "reverb" to the audible music. The filters can be implemented as analog or digital filters in hardware, software, or any combination thereof. Further, application of the filter to the audible music output, which in many embodiments corresponds to musical events represented by cues, can be done dynamically, that is, during play. Alternatively, the musical content may be processed before game play begins. In these embodiments, one or more files representing modified audible output may be created and musical events to output may be selected from an appropriate file responsive to the player's performance.

In addition to modification of the audio aspects of game events based on the player's performance, the visual appearance of those events may be modified based on the player's proficiency with the game. For example, failure to execute a game event properly may cause game interface elements to appear more dimly. Alternatively, successfully executing game events may cause game interface elements to glow more brightly. Similarly, the player's failure to execute game events may cause their associated avatar to appear embarrassed or dejected, while successful performance of game events may cause their associated avatar to appear happy and confident. In other embodiments, successfully executing cues associated with a lane causes the avatar associated with that lane to appear to play an instrument. For example, the drummer avatar will appear to strike the correct drum for producing the audible music. Successful execution of a number of successive cues may cause the corresponding avatar to execute a "flourish," such as kicking their leg, pumping their fist, performing a guitar "windmill," spinning around, winking at the "crowd," or throwing drum sticks.

Figure 2:
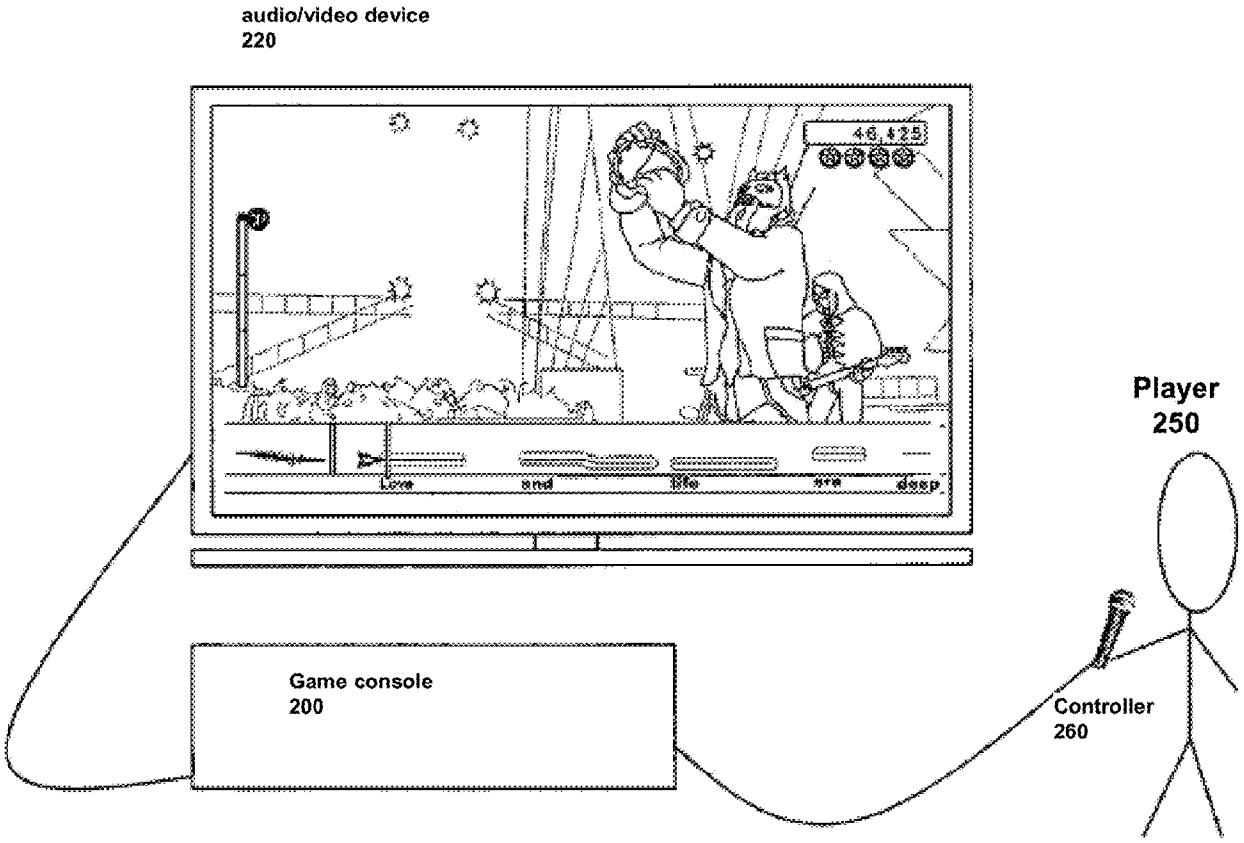
FIG. 2 is a block diagram showing a game console coupled to both an audio/video device and a microphone type controller via which a player can provide vocal input, according to some embodiments.

In some embodiments, player interaction with a cue may comprise singing a pitch and or a lyric associated with a cue. For example, the player associated with lane 101 may be required to sing into a microphone to match the pitches indicated by the gem 124 (alternatively referred to herein as the "note tube 124") as the gem 124 passes over the target marker 140. Referring ahead to FIG. 2, player interactions in these embodiments can be facilitated by a microphone type controller 260 that is connected to a game console 200, which is in turn connected to an audio/video device 220 (e.g., a television, monitor, or other display). The player 250 can sing into the microphone type controller 260 in order to interact with the game. As shown in FIG. 1A, the notes of a vocal track can be represented by "note tubes" 124. In the embodiment shown in FIG. 1A, the note tubes 124 appear at the top of the screen and flow horizontally, from right to left, as the musical content progresses. In this embodiment, vertical position of a note tube 124 represents the pitch to be sung by the player; the length of the note tube indicates the duration for which the player must hold that pitch. In other embodiments, the note tubes may appear at the bottom or middle of the screen. The arrow 108 provides the player with visual feedback regarding the pitch of the note that is currently being sung. If the arrow is above the note tube 124, the player needs to lower the pitch of the note being sung. Similarly, if the arrow 108 is below the note tube 124, the player needs to raise the pitch of the note being sung. In these embodiments, the vocalist may provide vocal input using a USB microphone of the sort manufactured by Logitech International of Switzerland. In other embodiments, the vocalist may provide vocal input using another sort of simulated microphone. In still further embodiments, the vocalist may provide vocal input using a traditional microphone commonly used with amplifiers. As used herein, a "simulated microphone" is any microphone apparatus that does not have a traditional XLR connector. As shown in FIG. 1A, lyrics 105 may be provided to the player to assist their performance.

Still referring to FIG. 1A, an indicator of the performance of a number of players on a single performance meter 180 is shown. In brief overview, each of the players in a band may be represented by an icon 181, 182. In the figure shown the icons 181 182 are circles with graphics indicating the instrument the icon corresponds to. For example, the icon 181 contains a microphone representing the vocalist, while icon 182 contains a drum set representing the drummer. The position of a player's icon on the meter 180 indicates a current level of performance for the player. A colored bar on the meter may indicate the performance of the band as a whole. Although the meter shown displays the performance of four players and a band as a whole, in other embodiments, any number of players or bands may be displayed on a meter, including two, three, four, five, six, seven, eight, nine, or ten players, and any number of bands. The performance of the player playing as the vocalist can be scored according to how closely the player's vocal input corresponds to the pitch indicated by note tube 124.

For example, when the player sings or speaks into the microphone, the microphone's input signal can be sampled (e.g., 60 times per second) and converted into a digital data stream. The digital data stream can be processed by a digital signal processing (DSP) module (not shown), which extracts pitch data from the digital data stream using known pitch extraction techniques. A compare module (not shown) can then compare a time stamp associated with a pitch sample from the player with one or more data records indicating the "correct" pitch associated with that time stamp in the song. If the player's vocal input exactly matches the pitch indicated by note tube 124, or if the player's vocal input is pitched within a "target range" (e.g., a range of pitches within a certain minimum and maximum pitch threshold around the "correct" pitch indicated by note tube 124), the player's score can rise. If the player's vocal input is pitched outside of the "target range," (e.g., is pitched "flat" or "sharp" relative to the correct pitch) the player's score can stay the same or decrease.

In some cases, there can be a time difference between the sample time and the time stamp of the data records. This can occur if, for example, the sample times are not precisely synchronized with the data records. In some embodiments, the compare module can compare the sample time of a pitch sample with the timestamps of one or more data records. For example, a pitch sample taken at sample time t=3 T can be compared to two or more data records that are closest in time to the sample time t=3 T. If there is a tie between two data records, a predetermined tie breaking policy can be used to select a data record (e.g., always select the data record with the earlier timestamp). This can allow simplification of the comparison process by obviating the need to ensure that sample times are precisely synchronized with the time stamps of the data records.

In some embodiments, the video game can be set at different levels of difficulty, such as "Easy," "Medium," "Hard," or "Expert." At lower difficulty levels (e.g., "Easy" or "Medium"), the width of the pitch "target range" can increase so as to increase the game's tolerance for vocal input that does not exactly match the pitch indicated by note tube 124. At higher difficulty levels (e.g., "Hard" or "Expert"), the width of the "target range" can decrease so as to decrease the game's tolerance for vocal input that does not match the correct note. Further details regarding visual cues, input methods, scoring methods, and methods for varying a display based on user input for rhythm-action games can be found in application Ser. No. 12/139,819, filed Jun. 16, 2008, titled "SYSTEMS AND METHODS FOR SIMULATING A ROCK BAND EXPERIENCE." The entire contents of this application are incorporated herein by reference. Further details regarding methods for analyzing and scoring a pitch sung by a player can also be found in U.S. Pat. No. 7,164,076, which corresponds to application Ser. No. 10/846,366, filed May 14, 2004, titled "SYSTEM AND METHOD FOR SYNCHRONIZING A LIVE MUSICAL PERFORMANCE WITH A REFERENCE PERFORMANCE." The entire contents of this application are incorporated herein by reference. For example, FIGS. 12-14 and column 19, line 44 through column 22, line 40 describe analyzing and scoring a pitch sung by a player.

Figure 1B:
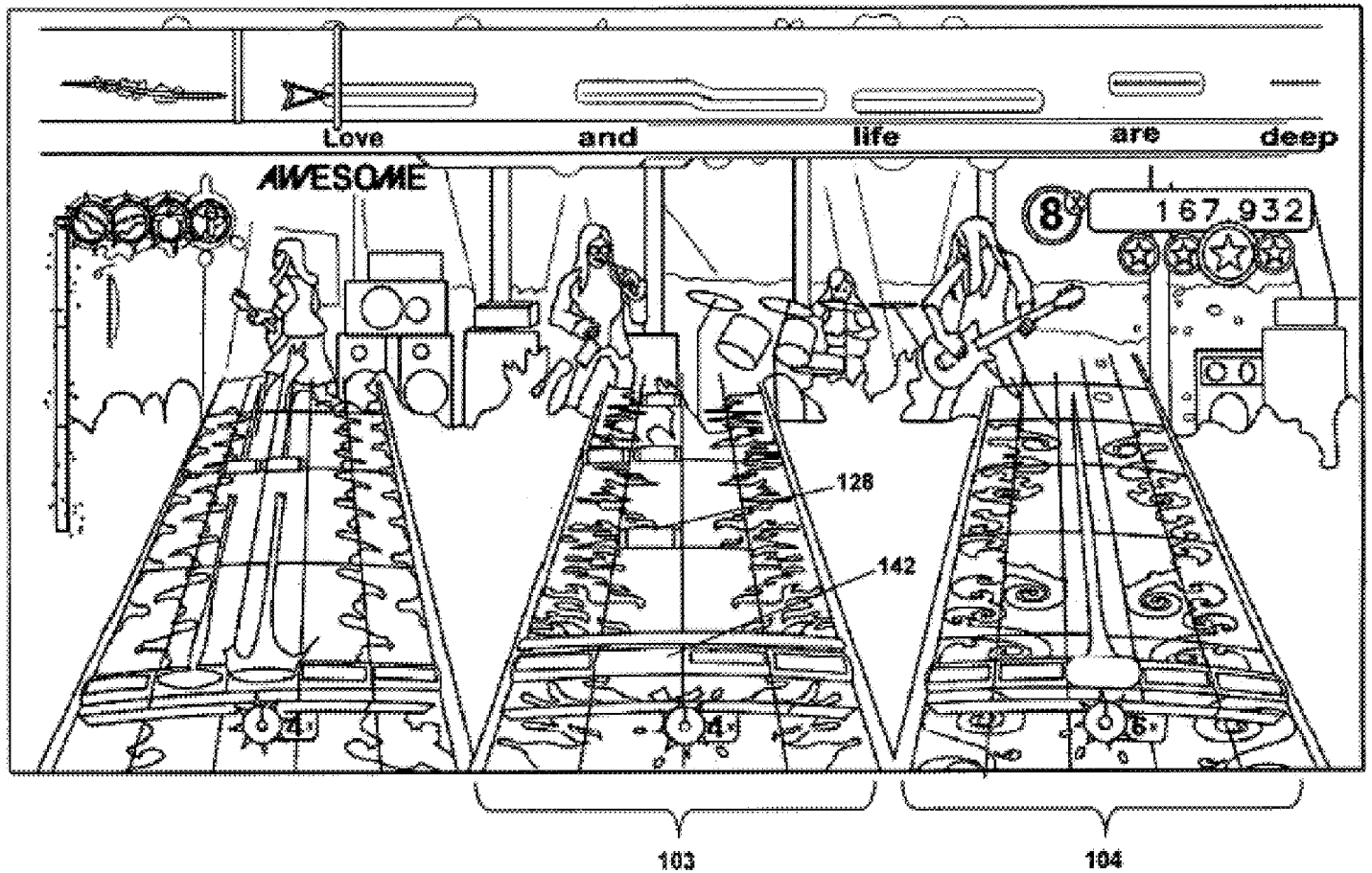
FIG. 1B shows a second embodiment of a screen display for a video game in which four players emulate a musical performance, according to some embodiments.

Referring now to FIG. 1B, a second embodiment of a screen display for a video game in which four players emulate a musical performance is shown. In the embodiment shown, the lanes 103 and 104 have graphical designs corresponding to gameplay events. For example, lane 103 comprises a flame pattern, which may correspond to a bonus activation by the player. For example, lane 104 comprises a curlicue pattern, which may correspond to the player achieving the 8× multiplier shown.

In some embodiments, the "lanes" containing the musical cues to be performed by the players may be on screen continuously. In other embodiments one or more lanes may be removed in response to game conditions, for example if a player has failed a portion of a song, or if a song contains an extended time without requiring input from a given player.

Although depicted in FIGS. 1A and 1B, in some embodiments (not shown), instead of a lane extending from a player's avatar, a three-dimensional "tunnel" comprising a number of lanes extends from a player's avatar. The tunnel may have any number of lanes and, therefore, may be triangular, square, pentagonal, sextagonal, septagonal, octagonal, nonagonal, or any other closed shape. In still other embodiments, the lanes do not form a closed shape. The sides may form a road, trough, or some other complex shape that does not have its ends connected. For ease of reference throughout this document, the display element comprising the musical cues for a player is referred to as a "lane."

In some embodiments, a lane does not extend perpendicularly from the image plane of the display, but instead extends obliquely from the image plane of the display. In further embodiments, the lane may be curved or may be some combination of curved portions and straight portions. In still further embodiments, the lane may form a closed loop through which the viewer may travel, such as a circular or ellipsoid loop.

Figure 3:
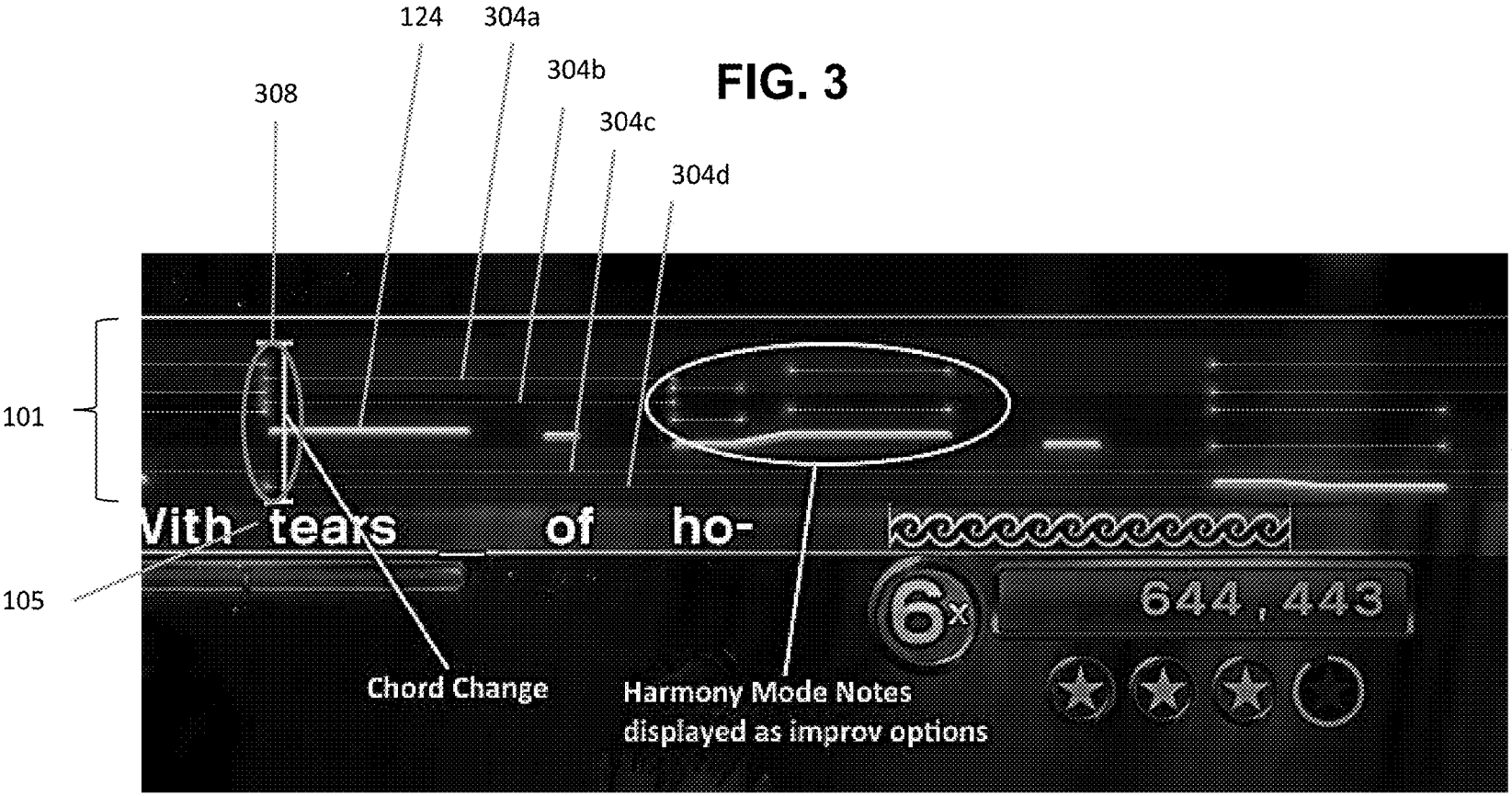
FIG. 3 shows an exemplary vocal lane with guidelines for facilitating a vocal improvisation feature, according to some embodiments.

FIG. 3 shows an exemplary vocal lane with guidelines for facilitating a vocal improvisation feature, according to some embodiments. FIG. 3 includes a close-up view of lane 101, lyrics 105, and note tubes 124 previously described in relation to FIG. 1A. FIG. 3 also includes improvisation guidelines 304*a*-*d*, as well as guideline end-markers 308.

When the vocal improvisation feature is enabled for the rhythm-action game, the rhythm-action game can be configured to display the improvisation guidelines 304*a-d* above and below the note tubes 124. Guidelines 304*a-d* can indicate acceptable pitches that a player can sing in harmony to the main melody of the song, indicated by the note tubes 124. Guidelines placed higher in lane 101 can indicate higher harmony pitches, while guidelines placed lower in lane 101 can indicate lower harmony pitches. In the example depicted in FIG. 3, guideline 304*a* can correspond to a higher pitch than guideline 304*b*, which in turn corresponds to a higher pitch than guideline 304*c*, which in turn corresponds to a higher pitch than guideline 304*d*. Guidelines 304*a-d* can appear both above and below note tubes 124, indicating that harmonies can be pitched both above and below the main melody of the song. The beginning and end of guidelines 304*a-d* can be demarcated by guideline end-markers 308, which in this embodiment appear as glowing points at the end of each guideline.

In some embodiments, appropriate harmony pitches can be pre-authored and encoded into metadata accompanying a musical track associated with the game level. For example, the musical track can be broken into a plurality of segments, wherein each segment is associated with a root chord. For example, for a song in the key of G, the musical track can be divided into segments corresponding to the G-chord, C-chord, D-chord, E-minor chord, or other chords. Transitions between segments in the musical track can correspond to chord changes in the musical track. A set of appropriate harmony pitches can be determined for each chord segment, such that the appropriate harmony pitches can change whenever the musical track undergoes a chord change. The set of appropriate harmony pitches for each chord segment can be pre-authored by a human operator. In addition, the set of appropriate harmony pitches for each chord segment can also be partly or wholly determined by an automatic algorithm before run-time. Harmony pitches can correspond to pitches that are a certain number of intervals above or below the root note for that chord (e.g., a third or fifth interval above the root note). Harmony pitches can also correspond to notes that are an augmented or diminished fifth above the root note for that chord. Embodiments that use only one set of harmony pitches for the entire duration of a chord segment can simplify the task of determining harmony pitches for both human operators and automatic algorithms.

Figure 7:
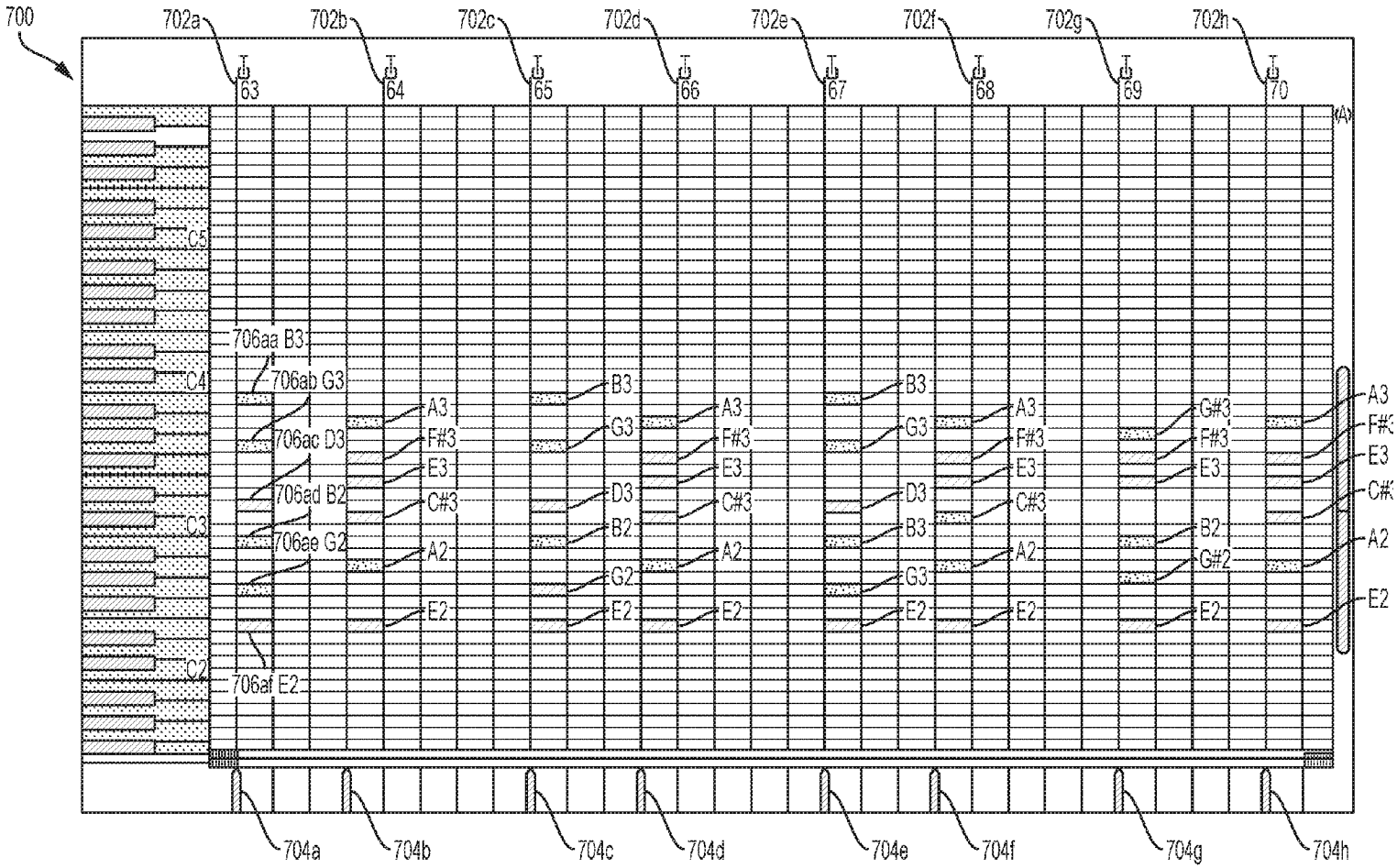
FIG. 7 is a conceptual view of a musical track associated with a game level, according to some embodiments.

FIG. 7 illustrates an exemplary conceptual view 700 of a musical track associated with the game level. The musical track in view 700 proceeds in time from left to right. The musical track can be broken up into a plurality of measures, each of which can comprise a plurality of beats, such as three beats or four beats. In the exemplary view 700, the musical track is broken into measures by measure dividers 702*a-h*, and each measure comprises four beats, as illustrated by the vertical lines subdividing each measure. The musical track in view 700 can also be broken up into a plurality of segments by segment dividers 704*a-h*, wherein each segment is associated with a root chord note (e.g., C, G, D, Em). Segment dividers 704*a-h* illustrate the points in the musical track in which the chord changes, and therefore show where one segment ends and the next begins. As can be seen, segment dividers 704*a-h* need not align with chord dividers 702*a-h*, as a song can change chords multiple times within one measure, or only after multiple measures have passed.

Each chord segment can be associated with a set of harmony pitches. The set of pitches 706*aa-af* illustrate an exemplary set of six pitches that are associated with the chord segment between segment divider 704*a* and 704*b*. Although not labeled, each chord segment can also be associated with other sets of six pitches. Musical tracks or chord segments with fewer or greater number of harmony pitches are also possible. In some embodiments, the pitches 706*aa-af* can be encoded as metadata within the musical track and can be pre-authored by a human operator, or determined automatically using an algorithm as described above. Each pitch 706*aa-af* can be rendered into a different guideline 304*a-d* in FIG. 3, and can represent a different harmony pitch that a player can sing. The pitches 706*aa-af* need not correspond to any actual, audible harmony track or sub-track in the musical track, and can be added to a song that has only an audible vocal melody and no audible vocal harmony.

In other embodiments, the rhythm-action game can determine appropriate harmony pitches by adding or subtracting a certain number of intervals from the note being played by the main melody line at that moment (e.g., a third or fifth above the note being played by the main melody line). Since the melody can change notes multiple times within one chord segment, determining harmony pitches in this way can require switching harmony pitches even within one segment with a common root chord. Other methods for determining the appropriate harmony note to go with the main melody line are also possible. In general, harmony notes are notes that are musically consonant with the main melody. Any method known to music theory for generating harmonies that are musically consonant with the main melody of the song can be used.

In some embodiments, the rhythm-action game being executed by the game console can determine the appropriate harmony pitches during run-time. Determining the appropriate harmony pitches during run-time can comprise determining the appropriate pitches after a song has been selected but before the song starts playing (e.g., while the song is loading). Determining harmony pitches during run-time can also comprise determining pitches while the song is playing. In general, the determination of appropriate harmony pitches can be done using any of the same algorithms described above for determining harmony pitches before run-time for encoding as part of the musical track's metadata. For example, if the musical track does not contain metadata that divides the musical track into chord segments (e.g., if the musical track does not contain segment dividers 704*a-h*), the rhythm-action game can analyze the melody line during run-time to divide the musical track associated with the game level into a plurality of chord segments, wherein each segment corresponds to a chord with a specific root note. For each segment, the rhythm-action game can determine harmony pitches based on the notes that correspond to the chord for that segment. Also as described above, the rhythm-action game can also determine harmony pitches by adding or subtracting a specified number of intervals from the main melody line. In some embodiments that determine harmony notes during run-time, no pre-authored information in addition to the main melody line is required. This can allow the rhythm-action game to implement the vocal improvisation feature even with legacy songs that only have pre-authored information pertaining to the main melody line.

Figure 4:
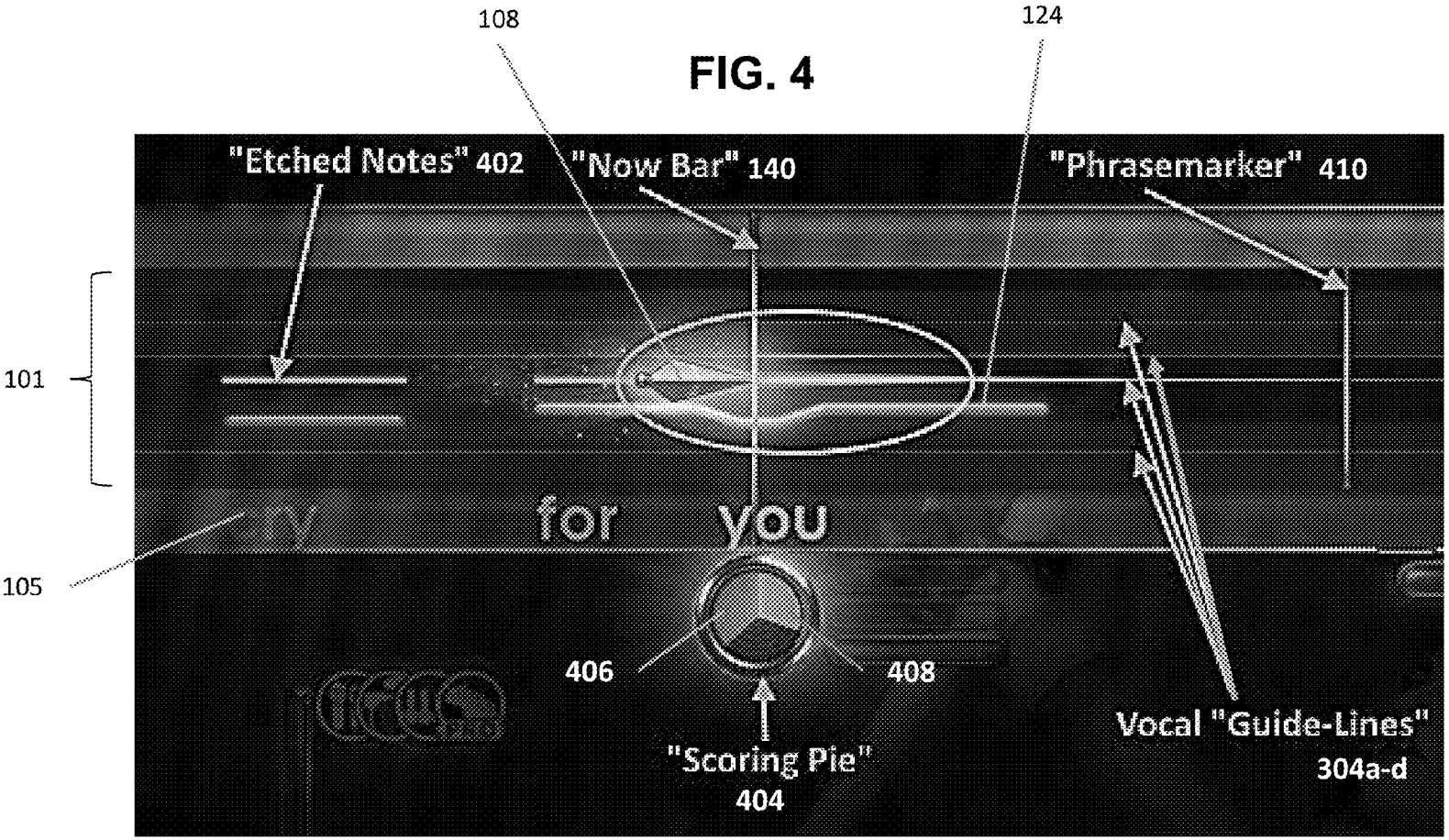
FIG. 4 shows an exemplary vocal lane illustrating how players using the vocal improvisation feature can be scored, according to some embodiments.

FIG. 4 shows an exemplary vocal lane illustrating how players using the vocal improvisation feature can be scored, according to some embodiments. FIG. 4 includes a close-up view of lane 101, lyrics 105, note tubes 124, arrow 108, now bar 140, all of which were previously discussed in relation to FIG. 1. FIG. 4 also includes guidelines 304 *a-d* previously discussed in relation to FIG. 3. Furthermore, FIG. 4 includes "etched notes" 402, "phrasemarker" 410, and a "scoring pie" 404, which includes a melody scoring meter 406 and an improvisation scoring meter 408.

A musical track corresponding to the current game level can be divided into a plurality of musical phrases, each of which can be separated by phrasemarker 410. As illustrated in FIG. 4, phrasemarker 410 can appear as a vertical line stretching across lane 101, although other ways of distinguishing one phrase from another are also possible. As players sing through a phrase, players can choose to sing either the melody (denoted by note tubes 124), vocal improvisation notes (denoted by the guidelines 304*a-d*), or a combination of both. As players adjust their vocal input's pitch towards one of the guidelines 304*a-d*, the intensity of the coloration of the closest guide-line can increase. Other nearby guide-lines can also light up, but less so until the player adjusts his/her vocal pitch towards that guide-line.

In some embodiments, players must follow the rhythm of the authored note tubes 124 in order to increase their score, but may choose to sing any of the harmony tones as dictated by the guide-lines 304*a-d*. In some embodiments, following the rhythm of the authored note tubes 124 can comprise starting to sing only when the note tubes 124 instruct the player to sing, and/or refraining from singing when the note tubes 124 instruct the player to stop singing. In yet other embodiments, the rhythm-action game can increase a player's score even if the player does not start or stop singing precisely at the right point(s) in time, but does so within a pre-determined "rhythm-tolerance window" that starts at a predetermined start time before the correct time and ends at a predetermined stop time after the correct time. The predetermined start time can be computed by subtracting a first time duration from the correct time, and the predetermined stop time can be computed by subtracting a second time duration from the correct time. The first time duration and the second time duration can be the same time duration, or one of these two time durations can be longer than the other.

The player can be considered to sing a particular harmony note correctly if the player's vocal input exactly matches the pitch of that harmony note (as indicated by guidelines 304*a-d*), or if the vocal input falls within a "target range" around one of said harmony notes. If the player is singing a particular harmony note correctly, arrow 108 can change appearance (e.g., change shape, color, size, or brightness). The guideline corresponding to the harmony note the player is singing can also be "etched" into lane 101 as it moves past now bar 140 from right to left. In FIG. 4, the player is singing a note corresponding to the guideline immediately above note tube 124. As a result, arrow 108 is glowing, and that guideline appears brighter than other guidelines as it moves past now bar 140 from right to left (see "etched note" 402). In some embodiments, etched note 402 can appear in a different color from note tube 124. For example, note tube 124 can be rendered in a blue color, whereas etched notes and guidelines can be rendered in an orange color.

Scoring for the player can be determined on a phrase-by-phrase basis. As used herein, a musical "phrase" can refer to a section of the musical track. Musical track phases can have uniform length or variable length throughout a musical track, and can encompass multiple measures or chord changes. For example, a phrase may encompass two, three, or four measures. In some cases, a single measure or chord segment can also contain multiple phrases. Scoring "pie" 404, which comprises a melody scoring meter 406 portion and a harmony scoring meter 408 portion, can indicate the player's score for the current musical phrase. If the player correctly sings the melody line in a phrase (e.g., sings within a pre-determined target range), the melody scoring meter 406 portion of the scoring pie 404 can fill starting from the 12 o'clock position in a counter-clockwise direction. If the player correctly sings one of the harmony lines (e.g., sings within a pre-determined target range) the improvisation scoring meter 408 portion of the scoring pie 404 can fill starting from the 12 o'clock position in a clockwise direction. In some embodiments, the melody scoring meter 406 and the improvisation scoring meter 408 can be rendered in different colors (e.g., blue for the melody scoring meter, and orange for the improvisation scoring meter). If the player correctly sings the melody line for the entire duration of the phrase, the scoring pie 404 can be completely filled with the melody scoring meter 406 (e.g., with blue) by the end of the phrase. If the player correctly sings one or more harmony lines for the entire duration of the phrase, the scoring pie 404 can be completely filled with the improvisation scoring meter 408 (e.g., with orange) by the end of the phrase. If the player correctly sings a mixture of melody and improvised harmony for the entire duration of the phrase, the scoring pie will be partially filled with the melody scoring meter 406 (e.g., with blue) and partially filled with the improvisation scoring meter 408 (e.g., with orange), but the scoring pie 404 will be completely filled by the combination of the two meters. For example, if the player correctly sings 70% of the phrase using the melody, and correctly sings 30% of the phrase using an improvised harmony, the scoring pie 404 will be completely filled: 70% of scoring pie 404 will be filled with the melody scoring meter 406 (e.g., with blue) and 30% of scoring pie 404 will be filled with the improvisation scoring meter 408 (e.g., with orange). If the scoring pie 404 is completely filled by the end of a phrase (whether with the melody scoring meter or improvisation scoring meter), the player can receive a perfect rating for that phrase. In some embodiments, if a player sings a phrase with a certain minimum amount of improvisation (e.g., if the improvisation scoring meter 408 spans at least 30% of scoring pie 404), the words "Improviser!" (or a similar statement) can appear on the screen after the player completes the phrase. At the end of a song, the video game can tabulate the percentage of the time that the player correctly sang a melody note, as well as the percentage of the time that the player correctly sang an improvised harmony note. The video game can also provide an overall score for the player, which can be based on the sum of the percentage corresponding to melody notes, and the percentage corresponding to improvised harmony notes. If the player fails to sing either the melody line or one of the permissible harmony lines correctly, the player can "fail" out of the game, thus causing the lane 101 to disappear from the game display. Failure to sing either the melody or the harmony lines correctly can also cause other aspects of the game's visual display to change. For example, the avatar associated with the player playing as a vocalist can appear embarrassed or dejected, or game interface elements may appear more dimly. Conversely, successfully singing either the melody of the harmony lines can cause the player's avatar to appear happy or confident, and/or execute a "flourish."

Figure 5:
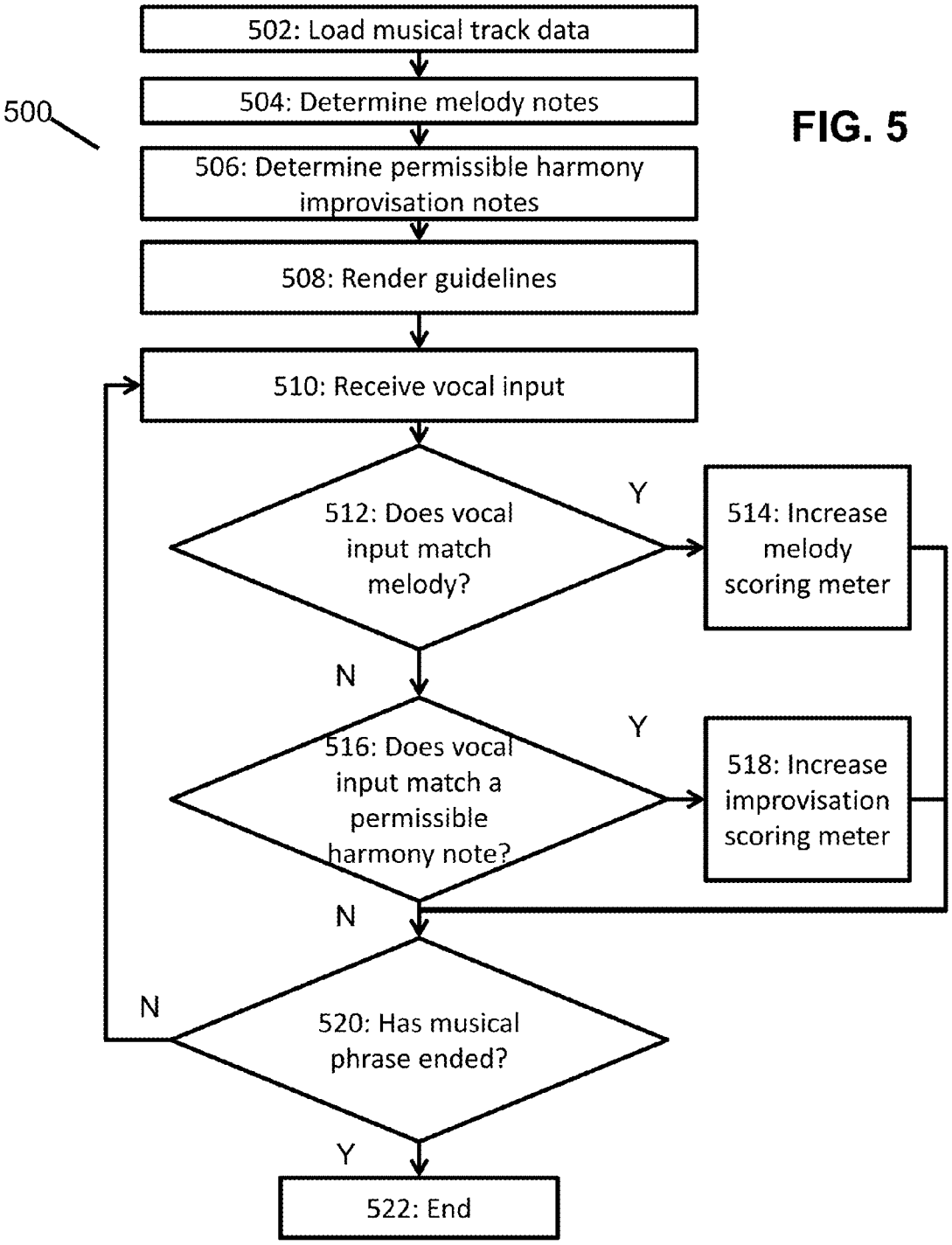
FIG. 5 is a flowchart depicting an exemplary process for prompting and scoring vocal improvisations within one musical phrase, according to some embodiments.

FIG. 5 is a flowchart depicting an exemplary process 500 for prompting and scoring vocal improvisations within one musical phrase, according to some embodiments. Process 500 is exemplary only and can be modified by changing, adding, deleting, or re-arranging at least some of its component steps.

At step 502, process 500 can load musical track data. The musical track data can be retrieved from a database, from a computer-readable media, or over a network, and can be stored in quick-access memory (e.g., volatile memory such as Random Access Memory (RAM)). The musical track data can comprise pre-authored notes and cues corresponding to a particular song, and can be encoded in the form of a MIDI file format. The musical track data can be loaded at the beginning of a song before play begins. Alternatively, the musical track data can be loaded during the song, as the song progresses from one musical phrase to the next.

At step 504, process 500 can determine the melody notes corresponding to that musical phrase. The melody notes can be determined from the pre-authored notes and cues encoded in the musical track data.

At step 506, process 500 can determine permissible harmony improvisation notes. As discussed previously, permissible harmony improvisation notes can be based on pre-authored metadata in the musical track data, or determined at runtime. The harmony notes can also be based on the melody notes, and/or on the current chord of the musical phrase. In some embodiments, each musical phrase can comprise only one chord, while in other embodiments, the musical phrase can comprise multiple chords.

At step 508, process 500 can render guidelines corresponding to both the main melody line of the musical track, as well as guidelines for permissible harmony lines. These guidelines can be displayed on the track 101, and correspond to note tubes 124 for the melody, and the guidelines 304*a-d* for permissible harmony lines. The placement of these guidelines can correspond to the melody notes and permissible harmony notes determined in steps 504 and 506, and also to the rhythm of the song.

At step 510, process 500 can receive vocal input from the player. The vocal input can be received via a microphone controller.

At step 512, process 500 can compare the vocal input against the melody and determine if the player's vocal input matches both the rhythm and the pitch of the melody line. At step 512, process 500 can make this comparison and determination using the methods described above in relation to FIG. 1A. If the player's input matches the rhythm of the melody line, and the player's pitch falls within the target range for the melody line, the process 500 can branch to step 514, where the process 500 increases the player's melody scoring meter, and from there to step 520. Otherwise, the process 500 can branch to step 516.

At step 516, process 500 compares the vocal input against the permissible harmony notes for the phrase. At step 516, process 500 can also make this comparison using the methods described above in relation to FIG. 1A. If the player's input matches the rhythm for the current musical phrase, and the player's pitch falls within the target range for one of the permissible harmony notes, the process 500 can branch to step 518, where the process 500 increases the player's improvisation scoring meter, and from there to step 520. Otherwise, the process 500 can branch straight to step 520.

At step 520, process 500 determines if the current musical phrase has ended. If the phrase has not ended, the video game branches back to step 510, where it again receives vocal input from the user. If the phrase has ended, process 500 branches to step 522, where it ends.

As discussed previously, some embodiments of the video game can be played at different difficulty settings, such as "Easy," "Medium," "Hard," and "Expert." These settings can be differentiated by the width of the target range. In these embodiments, if the target ranges for easier difficulty settings (e.g., "Easy" or "Medium") are too wide, they can interfere with scoring for the vocal improvisation feature. For example, the target range associated with the melody line can be so wide as to encompass some or all of the harmony pitches. In these embodiments, it can be advantageous to disable the vocal improvisation feature for easier difficulty settings. Instead, the vocal improvisation feature can be enabled only for harder difficulty settings (e.g., "Hard" or "Expert") where the target ranges are narrow enough to minimize interference with scoring vocal improvisations. In some embodiments, the target range associated with the melody line can be wider than the target range associated with some or all of the harmony pitches. If the target range associated with the melody line overlaps with the target range associated with one or more harmony pitches, and a player's vocal input falls within the overlapping region, the video game can be configured to give preference to the melody line by determining that the player has sung the melody.

Figure 6:
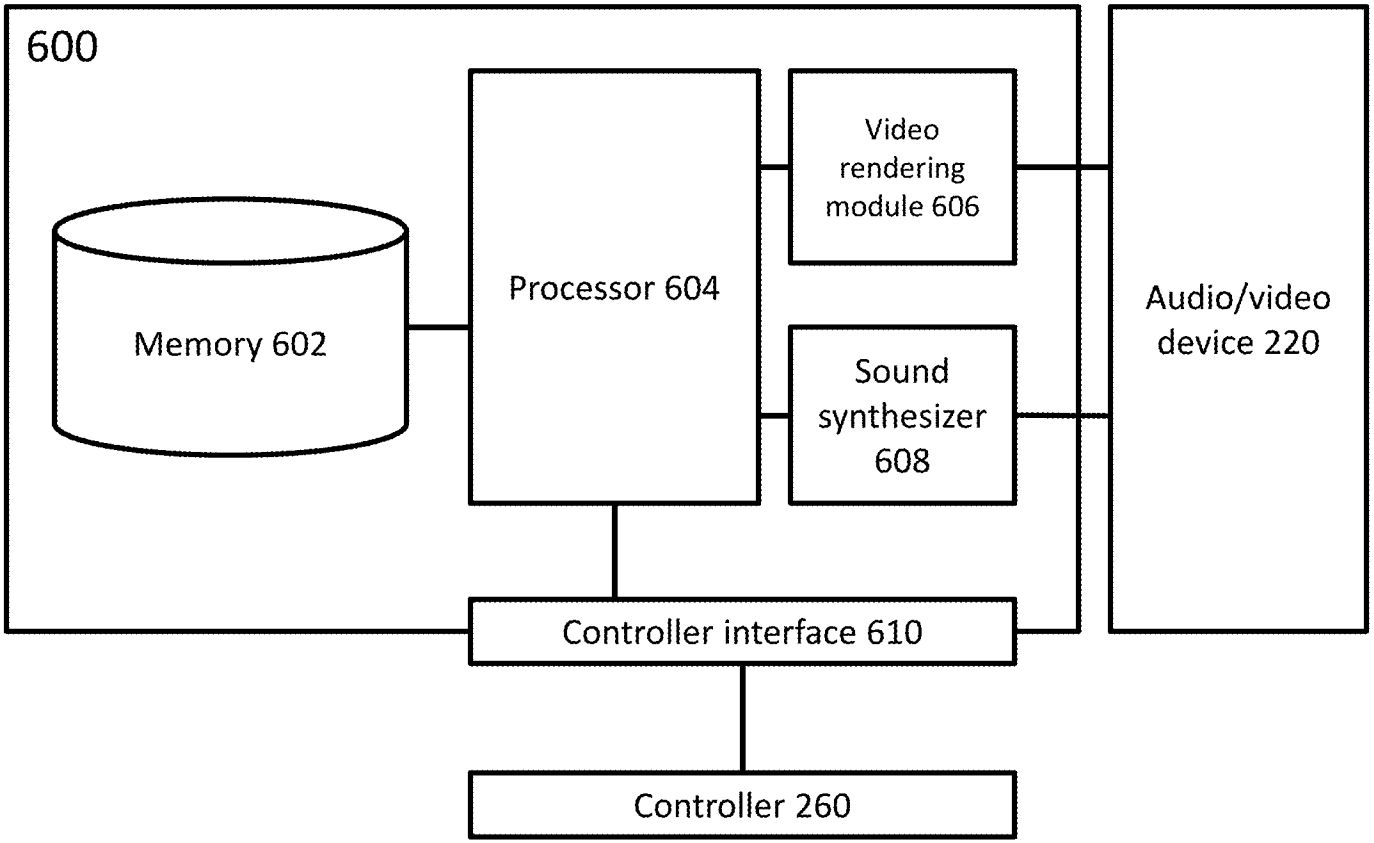
FIG. 6 is a block diagram illustrating in greater detail an exemplary apparatus for implementing a music video game with a vocal improvisation feature, according to some embodiments.

FIG. 6 is a block diagram illustrating in greater detail an exemplary apparatus 600 for implementing a music video game with the above-described vocal improvisation features. In some embodiments, apparatus 600 can be a dedicated game console, e.g., PLAYSTATION®3, PLAYSTATION®4, or PLAYSTATION®VITA manufactured by Sony Computer Entertainment, Inc.; WII™, WII U™, NINTENDO 2DS™, or NINTENDO 3DS™ manufactured by Nintendo Co., Ltd.; or XBOX®, XBOX 360®, or XBOX ONE® manufactured by Microsoft Corp. In other embodiments, apparatus 600 can be a general purpose desktop or laptop computer. In other embodiments, apparatus 600 can be a server connected to a computer network. In yet other embodiments, apparatus 600 can be a mobile device (e.g., iPhone, iPad, tablet, etc.). Apparatus 600 can include a memory 602, processor 604, video rendering module 606, sound synthesizer 608, and a controller interface 610. The controller interface can be used to couple apparatus 600 with a controller 260, whereas video rendering module 606 and sound synthesizer 608 can connect to an audio/video device 220.

Memory 602 can include musical track data that comprises pre-authored notes and cues corresponding to a particular song. Memory 602 can also include machine-readable instructions for execution on processor 604. Memory can take the form of volatile memory, such as Random Access Memory (RAM) or cache memory. Alternatively, memory can take the form of non-volatile memory, including by way of example semiconductor memory devices, e.g., EPROM, EEPROM, and flash memory devices; magnetic disks, e.g., internal hard disks or removable disks. In some embodiments, memory 602 can be configured to retrieve and store musical track data from portable data storage devices, including magneto-optical disks, and CD-ROM and DVD-ROM disks. In other embodiments, memory 602 can be configured to retrieve and store musical track data over a network via a network interface (not shown).

Processor 604 can take the form of a programmable microprocessor executing machine-readable instructions. Alternatively, processor 604 can be implemented at least in part by special purpose logic circuitry, e.g., an FPGA (field programmable gate array) or an ASIC (application-specific integrated circuit) or other specialized circuit. Processor 604 can be configured to execute the steps in process 500, described above in relation to FIG. 5. Alternatively, processor 604 can be configured to execute only some of the steps in process 500, and other components can execute the remaining steps; for example, memory 602 can be configured to at least partly execute step 502 (load musical track data), and video rendering module 606 can be configured to at least partly execute step 510 (render guidelines).

Processor 604 can be coupled with controller interface 610, which can be any interface configured to be coupled with an external controller. As depicted in FIG. 6, controller interface 610 can in turn be coupled with an external controller 260. As described above in relation to FIG. 2, external controller 260 can take the form of a microphone controller capable of receiving vocal input from a player. In some embodiments, the external controller 260 can also comprise an analog-to-digital (A-to-D) converter that converts the analog vocal input into digital signals capable of being processed by processor 604. In other embodiments, an A-to-D converter can be integrated into at least one of the controller interface 610 and processor 604, or another part of apparatus 600.

Processor 604 can also be coupled to video rendering module 606 and sound synthesizer 608. While both modules are depicted as separate hardware modules outside of processor 604 (e.g., as stand-alone graphics cards or sound cards), other embodiments are also possible. For example, one or both modules can be implemented as specialized hardware blocks within processor 604. Alternatively, one or both modules can be implemented purely as software running within processor 604. Video rendering module 606 can be configured to generate a video display based on instructions from processor 604, while sound synthesizer 608 can be configured to generate sounds accompanying the video display. Video rendering module 606 and sound synthesizer 608 can be coupled to an audio/video device 220, which can be a TV, monitor, or other type of device capable of displaying video and accompanying audio sounds. While FIG. 6 shows two separate connections into audio/video device 220, other embodiments in which the two connections are combined into a single connection are also possible.

The above-described techniques can be implemented in digital electronic circuitry, or in computer hardware, firmware, software, or in combinations of them. The implementation can be as a computerized method or process, or a computer program product, i.e., a computer program tangibly embodied in a machine-readable storage device, for execution by, or to control the operation of, data processing apparatus, e.g., a programmable processor, a computer, a game console, or multiple computers or game consoles. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or game console or on multiple computers or game consoles at one site or distributed across multiple sites and interconnected by a communication network.

Method steps (such as method steps in process 500) can be performed by one or more programmable processors executing a computer or game program to perform functions of the invention by operating on input data and generating output. Method steps can also be performed by, and apparatus can be implemented as a game platform such as a dedicated game console, e.g., PLAYSTATION®3, PLAYSTATION®4, or PLAYSTATION®VITA manufactured by Sony Computer Entertainment, Inc.; WII™, WII U™, NINTENDO 2DS™, or NINTENDO 3DS™ manufactured by Nintendo Co., Ltd.; or XBOX®, XBOX 360®, or XBOX ONE® manufactured by Microsoft Corp.; or special purpose logic circuitry, e.g., an FPGA (field programmable gate array) or an ASIC (application-specific integrated circuit) or other specialized circuit. Modules can refer to portions of the computer or game program or gamer console and/or the processor/special circuitry that implements that functionality.

Processors suitable for the execution of a computer program include, by way of example, both general and special purpose microprocessors, and any one or more processors of any kind of digital computer or game console. Generally, a processor receives instructions and data from a read-only memory or a random access memory or both. The essential elements of a computer or game console are a processor for executing instructions and one or more memory devices for storing instructions and data. Generally, a computer also includes, or is operatively coupled, to receive data from or transfer data to, or both, one or more mass storage devices for storing data, e.g., magnetic, magneto-optical disks, or optical disks. Data transmission and instructions can also occur over a communications network. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a player, the above described techniques can be implemented on a computer or game console having a display device, e.g., a CRT (cathode ray tube) or LCD (liquid crystal display) monitor, a television, or an integrated display, e.g., the display of a PLAYSTATION®VITA or Nintendo 3DS. The display can in some instances also be an input device such as a touch screen. Other typical inputs include simulated instruments, microphones, or game controllers. Alternatively, input can be provided by a keyboard and a pointing device, e.g., a mouse or a trackball, by which the player can provide input to the computer or game console. Other kinds of devices can be used to provide for interaction with a player as well; for example, feedback provided to the player can be any form of sensory feedback, e.g., visual feedback, auditory feedback, or tactile feedback; and input from the player can be received in any form, including acoustic, speech, or tactile input.

The above described techniques can be implemented in a distributed computing system that includes a back-end component, e.g., as a data server, and/or a middleware component, e.g., an application server, and/or a front-end component, e.g., a client computer or game console having a graphical player interface through which a player can interact with an example implementation, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet, and include both wired and wireless networks.

The computing/gaming system can include clients and servers or hosts. A client and server (or host) are generally remote from each other and typically interact through a communication network. The relationship of client and server arises by virtue of computer programs running on the respective computers and having a client-server relationship to each other.

The invention has been described in terms of particular embodiments. The alternatives described herein are examples for illustration only and not to limit the alternatives in any way. The steps of the invention can be performed in a different order and still achieve desirable results.

The invention claimed is:

1. A computer system for evaluating a player's vocal performance comprising at least some vocal improvisation that does not correspond to a melody of a musical track, the system comprising:

a memory that stores the musical track, the musical track having a first set of notes corresponding to the melody;

at least one processor configured to:

determine a second set of notes corresponding to potential harmonies that are musically consonant with the melody;

receive vocal input corresponding to the player's vocal performance;

determine if a pitch of the vocal input falls within a pre-determined range of at least one note of the first set of notes or at least one note of the second set of notes; and increase a score of the player when the pitch of the vocal input falls within the pre-determined range of at least one note of the first set of notes or at least one note of the second set of notes;

a sound synthesizer coupled to the at least one processor, wherein the at least one processor is further configured to transmit to the sound synthesizer an audible soundtrack.

2. The system of claim 1, wherein the at least one processor is configured to decrease or leave unchanged the score of the player when the pitch of the vocal input does not fall within the pre-determined range of at least one note of the first set of notes and at least one note of the second set of notes.

3. The system of claim 1, further comprising a video rendering module coupled to the at least one processor, wherein the at least one processor is further configured to transmit to the video rendering module display data comprising a lane having a first set of cues corresponding to the first set of notes, and a second set of cues corresponding to the second set of notes.

4. The system of claim 3, wherein the at least one processor is configured to change the appearance of a selected cue in the second set of cues when the pitch of the vocal input falls within the pre-determined range of a note that corresponds to the selected cue.

5. The system of claim 1, wherein:

the score of the player is a score for a musical phrase, the score being subdivided into a first part and a second part; and the at least one processor is configured to increase the first part of the score when the pitch of the vocal input falls within the pre-determined range of at least one note of the first set of notes, and to increase the second part of the score when the pitch of the vocal input falls within the pre-determined range of at least one note of the second set of notes.

6. The system of claim 1, wherein the at least one processor is further configured to determine if a rhythm of the vocal input corresponds to a rhythm associated with the musical track, and if so, to increase the score of the player.

7. The system of claim 1, wherein the at least one processor is configured to determine the second set of notes during run-time.

8. The system of claim 1, wherein the at least one processor is configured to determine the second set of notes based on metadata associated with the musical track.

9. The system of claim 1, wherein the audible soundtrack corresponds to the musical track and is transmitted to the sound synthesizer by the at least one processor while receiving the vocal input.

10. The system of claim 9, wherein the second set of notes does not correspond to an audible harmony in the audible soundtrack.

11. A method for evaluating a player's vocal performance comprising at least some vocal improvisation that does not correspond to a melody of a musical track, the method being executed by a computing device comprising at least one processor and at least one memory in communication with the processor, the method comprising:

accessing the musical track from the at least one memory, the musical track having a first set of notes corresponding to the melody;

determining a second set of notes corresponding to potential harmonies that are musically consonant with the melody;

receiving vocal input corresponding to the player's vocal performance;

determining if a pitch of the vocal input falls within a pre-determined range of at least one note of the first set of notes or at least one note of the second set of notes;

increasing a score of the player when the pitch of the vocal input falls within the pre-determined range of at least one note of the first set of notes or at least one note of the second set of notes; and transmitting an audible soundtrack to a sound synthesizer coupled to the processor.

12. The method of claim 11, further comprising decreasing or leaving unchanged the score of the player when the pitch of the vocal input does not fall within the pre-determined range of at least one note of the first set of notes and at least one note of the second set of notes.

13. The method of claim 11, further comprising transmitting display data comprising a lane having a first set of cues corresponding to the first set of notes, and a second set of cues corresponding to the second set of notes.

14. The method of claim 13, further comprising changing the appearance of a selected cue in the second set of cues when the pitch of the vocal input falls within the pre-determined range of a note that corresponds to the selected cue.

15. The method of claim 11, wherein:

the score of the player is a score for a musical phrase, the score being subdivided into a first part and a second part; and the method further comprises increasing the first part of the score when the pitch of the vocal input falls within the pre-determined range of at least one note of the first set of notes, and increasing the second part of the score when the pitch of the vocal input falls within the pre-determined range of at least one note of the second set of notes.

16. The method of claim 11, further comprising determining if a rhythm of the vocal input corresponds to a rhythm associated with the musical track, and if so, increasing the score of the player.

17. The method of claim 11, further comprising determining the second set of notes during run-time of the method.

18. The method of claim 11, further comprising determining the second set of notes based on metadata associated with the musical track.

19. The method of claim 11, wherein the audible soundtrack corresponds to the musical track, and is transmitted while receiving the vocal input.

20. The method of claim 19, wherein the second set of notes does not correspond to an audible harmony in the audible soundtrack.

21. Non-transitory computer readable media storing machine-readable instructions that are configured to, when executed by at least one processor, cause the at least one processor to:

access the musical track from at least one memory in communication with the at least one processor, the musical track having a first set of notes corresponding to the melody;

determine a second set of notes corresponding to potential harmonies that are musically consonant with the melody;

receive vocal input corresponding to the player's vocal performance;

determine if a pitch of the vocal input falls within a pre-determined range of at least one note of the first set of notes or at least one note of the second set of notes;

increase a score of the player when the pitch of the vocal input falls within the pre-determined range of at least one note of the first set of notes or at least one note of the second set of notes; and transmit an audible soundtrack to a sound synthesizer coupled to the processor.

* * * * *